US008881442B2

(12) United States Patent
Elftmann, Jr.

(10) Patent No.: US 8,881,442 B2
(45) Date of Patent: Nov. 11, 2014

(54) DUAL TRIGGER FOR SEMI-AUTOMATIC RIFLE

(71) Applicant: Arthur Joseph Elftmann, Jr., Glendale, AZ (US)

(72) Inventor: Arthur Joseph Elftmann, Jr., Glendale, AZ (US)

( * ) Notice: Subject to any disclaimer, the term of this patent is extended or adjusted under 35 U.S.C. 154(b) by 2 days.

(21) Appl. No.: 13/749,017

(22) Filed: Jan. 24, 2013

(65) Prior Publication Data

US 2013/0192116 A1 Aug. 1, 2013

Related U.S. Application Data

(60) Provisional application No. 61/591,869, filed on Jan. 28, 2012.

(51) Int. Cl.
*F41A 19/10* (2006.01)

(52) U.S. Cl.
CPC ..... *F41A 19/10* (2013.01)
USPC ..... 42/69.01; 42/42.03; 89/136

(58) Field of Classification Search
CPC ..... F41A 19/10; F41A 19/11; F41A 19/00
USPC ..... 42/69.01, 41, 42.01–42.03; 124/31; 89/27.11, 136
See application file for complete search history.

(56) References Cited

U.S. PATENT DOCUMENTS

| | | | | |
|---|---|---|---|---|
| 361,100 | A * | 4/1887 | Wesson | 42/65 |
| 3,269,045 | A * | 8/1966 | McGaughey | 42/65 |
| 7,430,827 | B1 * | 10/2008 | Huber | 42/69.01 |
| 2003/0178018 | A1 * | 9/2003 | Cherry | 124/76 |
| 2009/0266348 | A1 * | 10/2009 | Yeh | 124/31 |
| 2011/0173859 | A1 * | 7/2011 | Findlay | 42/69.01 |

OTHER PUBLICATIONS

Bob Boyd, Elftmann Tactical: Dual Enhancement Trigger (D-TR), on-line article from www.shootingillustrated.com, Oct. 26, 2012.

* cited by examiner

*Primary Examiner* — Bret Hayes
*Assistant Examiner* — Joshua Freeman
(74) *Attorney, Agent, or Firm* — Douglas W. Rudy

(57) ABSTRACT

A dual trigger assembly for a rifle. The assembly includes the major components of the dual trigger and a trigger guard that is formed to accommodate the dual trigger. The dual trigger assembly may replace a single trigger assembly without the need for machining the rifle that will be provided with the dual trigger assembly.

2 Claims, 5 Drawing Sheets

DUAL TRIGGER FOR SEMI-AUTOMATIC RIFLE

CLAIM OF PRIORITY

This application claims the benefit of U.S. Provisional Application 61/591,869 for "Double Trigger For Colt AR-15 Semi-automatic Rifle and Other Semi-automatic rifles of Similar Design" filed on Jan. 28, 2012. The inventor of that application is Arthur Joseph Elftmann, Jr. . That application is incorporated in its entirety in this non-provisional patent application.

BACKGROUND OF THE INVENTION

1. Field of the Invention

This invention is a dual trigger and a trigger guard for a semi-automatic rifle such as the "Colt" brand, "AR-15" brand ["Colt" and "AR-15" are trademarks of Colt Industries] as well as similar semi-automatic rifles or clones of the "Colt" "AR-15" semi-automatic rifle made by many companies throughout the world. The device is a replacement of the stock or original equipment trigger carried in the lower receiver portion of a semi-automatic rifle. This dual trigger is made to replace the original single trigger and single trigger guard provided with the stock rifle without impairing the functionality of the original rifle.

2. Description of Known Art

This dual trigger and trigger guard is not known to be used on semi-automatic rifles such as the AR-15 or its clones.

It is known to use dual triggers on paint ball guns. The dual triggers used in paint ball guns operate differently than this invention. In a paint ball gun the trigger closes a simple spring-loaded normally open electrical switch that the upper part of the trigger contacts when the trigger is pulled. The paint ball gun trigger electrical switch moves a valve to release a charge of air to propel a projectile. In the dual trigger invention presented the trigger includes an insertable hammer contact portion that contacts the hammer of the rifle. The dual trigger also includes a transition zone extending from an upper trigger bow to a lower trigger bow that is connected to and extends from the transition zone of the trigger. This trigger is a pure mechanical device without an electrical switch. Paint ball gun triggers do not have or need a hammer contact element, nor the transition zone as are part of the dual trigger presented here.

It is also known that stock triggers in AR-15 style rifles have triggers with accuracy-robbing characteristics, such as, but not limited to, excessive trigger take-up and a propensity to accumulate grit in the trigger mechanism causing trigger creep that makes for inconsistent trigger let-off. As will be addressed further on, the dual trigger presented here overcomes those shortcomings and provides a trigger that enhances the accuracy of an AR.-15.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, a dual trigger for use as a direct replacement of the standard single trigger and trigger guard of an AR-15 style semi-automatic rifle. In one embodiment of this invention the dual trigger includes dual trigger bows vertically arranged one above the other in a semi-staggered orientation with the lower bow slightly behind the upper bow. The trigger looks like it is two separate triggers but it is a single trigger with two trigger bows connected to each other in a transition zone such that the dual trigger is formed to resemble two separate triggers.

An object of this invention is to provide a dual trigger that is easily installed in the lower receiver of an AR-15 style semi-automatic rifle.

It is also an object of the invention to provide a dual trigger that is a direct fit into a lower receiver of an AR-15 style semi-automatic weapon without the need for any special tools, machining operations, or gunsmithing experience.

Another object of this invention is to increase the firing rate of a semi-automatic AR-15 style rifle by providing for two-finger operation of a single trigger.

Similarly, one advantage of the invention is that a shooter can more easily use his or her middle finger to pull the trigger of the rifle equipped with the dual trigger of the invention.

A further object of the invention is to provide a dual trigger with reduced trigger pull resistance on one of the trigger locations of the dual trigger.

It is also an advantage of this dual trigger to lower the trigger pull effort rate to provide for single precision shots from a semi-automatic rifle.

Also an advantage is that the dual trigger allows for an increase in the rate of fire but doesn't generate an increase in the rate of muzzle lift.

Another advantage of this dual trigger is that the pull weight of the lower trigger is reduced by nearly sixty percent due to the additional leverage provided by the length of the dual trigger.

A further object of the invention is that the dual trigger results in increased firing speed.

A further advantage is that the trigger enables better utilization of ammunition as the accuracy of the rifle is improved.

Another object of the invention is to provide a trigger replacement that can easily be installed in less than an hour without the need to hire a gunsmith to do the dual trigger installation.

Another advantage of the dual trigger presented here is that it provides a unique appearance that changes the profile of an AR-15 style rifle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar.

Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the figures in which.

Elements depicted in the figure are illustrated for simplicity. They are presented to illustrate the invention to assist in an understanding thereof The figures are not necessarily rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

It should also be pointed out that the front of the trigger assembly is the direction that finger contacting portion of the trigger faces. The back or rear of the trigger assembly is the direction that the trigger is pulled when being fired. That is, the trigger is pulled back when being fired. The trigger is generally mounted to the rifle such that the trigger is pointed away from the lower receiver in a downwardly facing direction as is usual.

Figure 1:
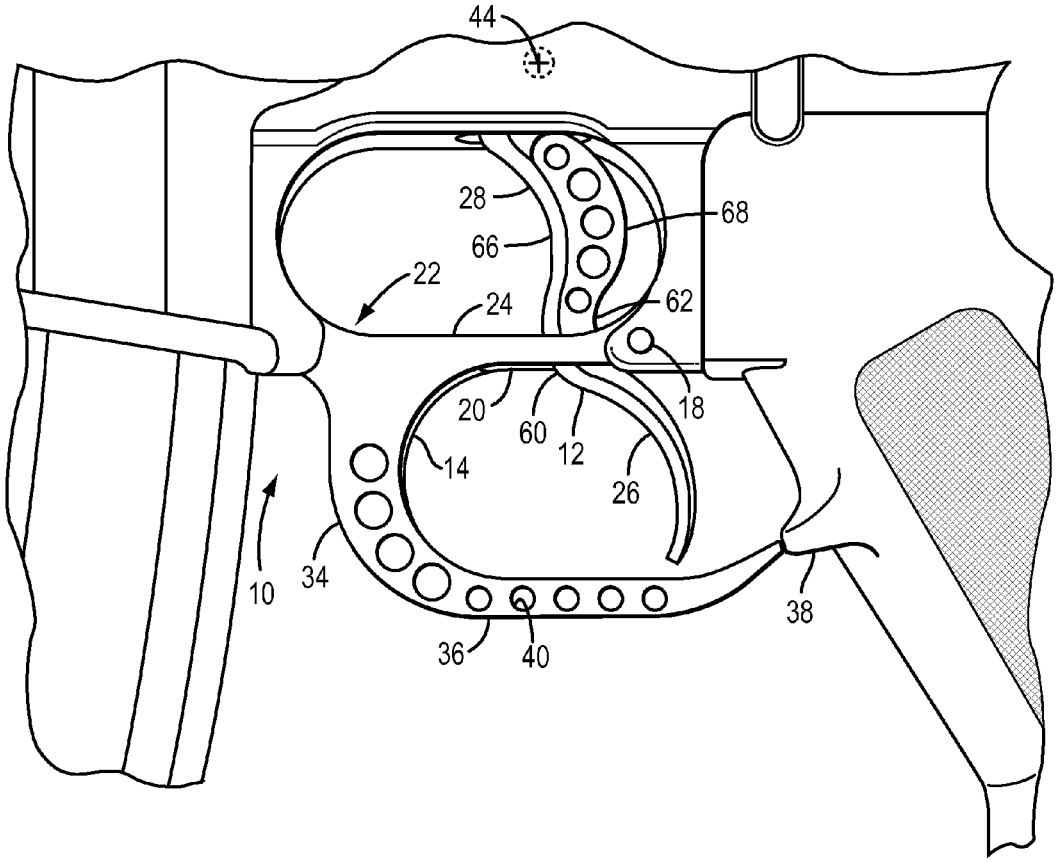
FIG. 1 is a side elevation view of the dual trigger as installed in a portion of an AR-15 style semi-automatic rifle.

Turning to FIG. 1, there is a representation of the lower receiver section of an AR-15 semi-automatic rifle lower section, generally 10. In this view a portion of a magazine is shown on the left side of the figure and a portion of the handle or grip is shown on the right side of the figure. The original single trigger and the original trigger guard are replaced in this figure with the dual trigger 12 and the dual trigger guard 14.

Figure 2:
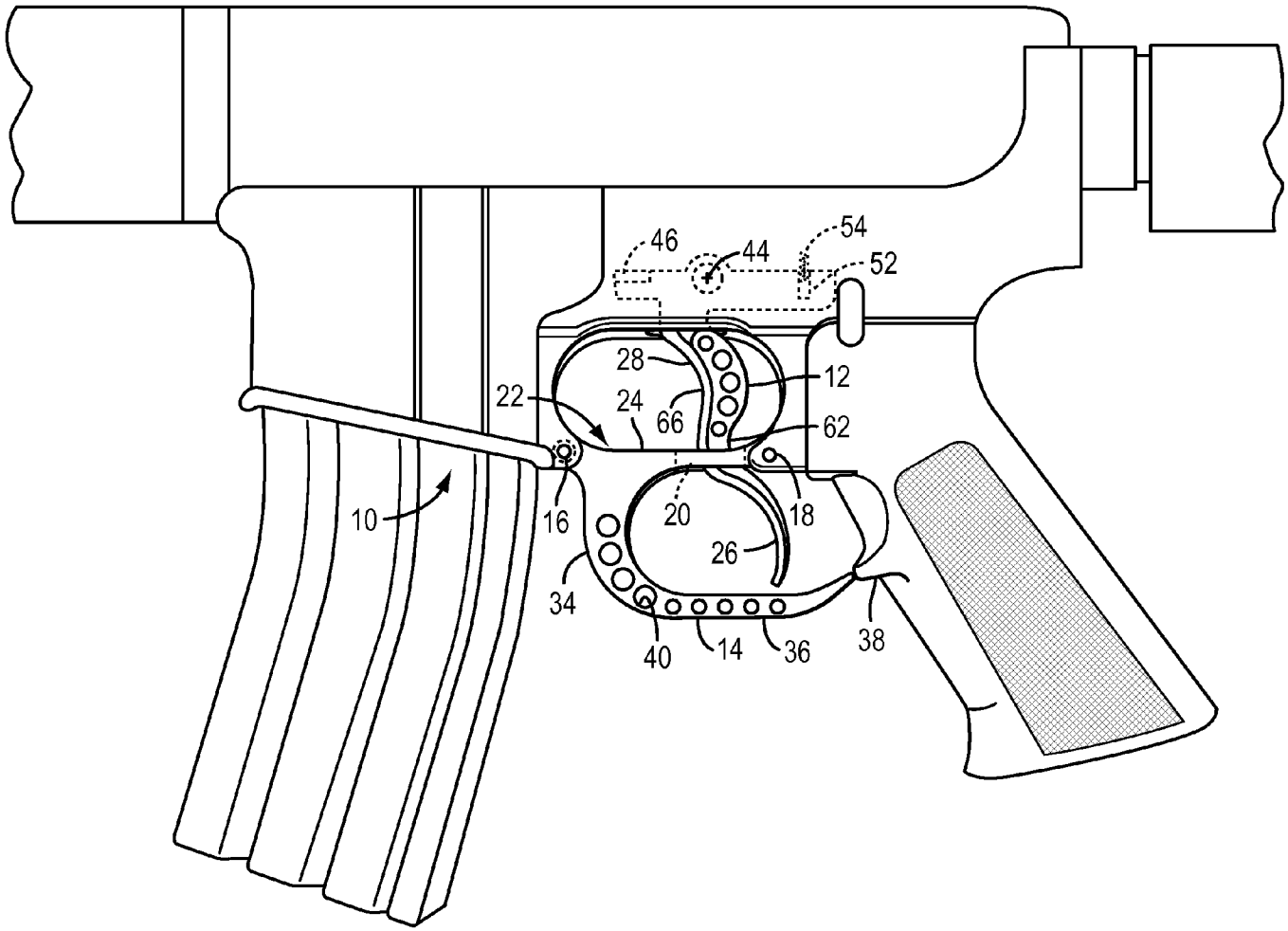
FIG. 2 is a side elevation view of the dual trigger as installed in a partially broken away portion of a lower receiver of an AR-15 style semi-automatic rifle.
Figure 3:
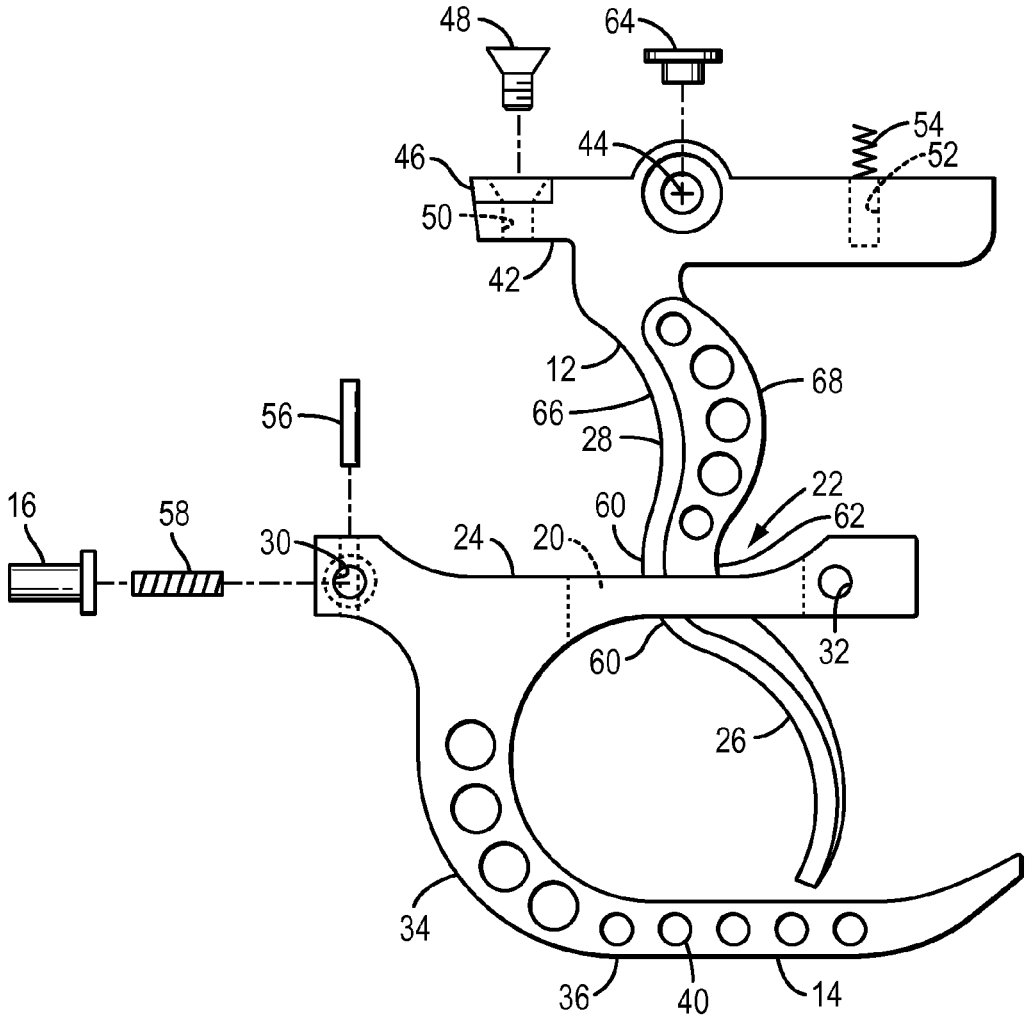
FIG. 3 is an expanded view of the components making up the dual trigger assembly.

Looking also at FIGS. 2 and 3, the original single trigger guard is held to the lower receiver by spring loaded trigger guard push button 16 and trigger guard rear pivot roll pin 18. The original trigger guard is generally a straight bridge from spring loaded trigger guard push button 16 to pin 18 as is well known in the AR-15 field and comports with MIL-SPEC for the AR-15. The original trigger will not extend through or beyond the top surface of the original trigger guard however the dual trigger guard is formed with a cavity 20 in the upper section 24 of the dual trigger guard 14 to allow passage of the lower trigger portion, or lower trigger bow 26 of the dual trigger 12 to pass through the upper section 24 of the dual trigger guard.

The upper section 24 of the dual trigger guard 14 extends beyond the spring loaded trigger guard push button 16 and trigger guard rear pivot roll pin 18 locations and is provided with first and second trigger guard pin and/or push button receiving bores 32 and 30, respectively, to accommodate the spring loaded trigger guard push button 16 and trigger guard rear pivot roll pin 18 respectively, which enter bores in the lower receiver section. The spring loaded trigger guard push button 16 comprises a spring-loaded pushpin capable of being pushed in to allow the front end of the trigger guard to be removed from the lower receiver. This is well known to people familiar with the AR-15. The spring loaded trigger guard push button 16 and trigger guard rear pivot roll pin 18 then pass through the trigger guard bores 30 and 32 in the upper section 24 of the dual trigger guard into bores on the other side of the lower receiver of the AR-15 lower receiver. This attachment configuration of the trigger guard to the lower receiver of the AR-15 is used on the original single trigger guard as is also well known to AR-15 aficionados.

An advantage in fitting the dual trigger 12 to an AR-15 style semi-automatic rifle is that the original mounting location and system for mounting the dual trigger and dual trigger guard 14 to the lower receiver of the AR-15 is that no modifications to the lower receiver of the AR-15 are necessary. The original single trigger guard is removed and the replacement dual trigger guard is installed in its place using the same pins in the same location as the original single trigger guard.

The dual trigger guard 14 includes a forward section 34 and a trigger guard transition section 36. The transition section 36 extends to the grip portion 38 of the rifle in this embodiment. The transition section 36 may end at the grip portion 38 as shown or the transition section may be extended upwardly or downwardly in other embodiments of the dual trigger guard. A plurality of apertures such as the one aperture shown as 40 may optionally be formed in the dual trigger guard 14 in one embodiment of the invention. The optional apertures, whether through apertures, or, in another embodiment, indentations, may reduce the weight of the dual trigger guard 14 as well as provide a pleasing design element. Other embodiments are contemplated by the inventor, such as, but not limited to a lack of any apertures, the provision of through bores, the provision of bores that don't go all the way through the trigger guard, or bores of different shapes and sizes and any number of apertures, bores or other surface elements.

In FIG. 3 details of the dual trigger assembly are shown. In addition to the items mentioned above the dual trigger guard 14 also comprises a valley section, generally 22. This valley section 22 allows for finger space above the dual trigger guard.

The dual trigger 12 includes the lower trigger portion, or lower trigger bow, 26 extending downwardly from an upper trigger portion, or upper trigger bow 28. These two portions are formed together as a single piece and are thus connected together in the transition zone 60 of the dual trigger where the transition zone 60 and the lower bow 26 pass through the longitudinal cavity 20 of the dual trigger guard 14. The back side 62 of the transition zone 60 is curved toward the front side of the transition zone to provide clearance for the transition zone between the upper and lower trigger bows so that the dual trigger does not strike the pin 18 or the body of the trigger guard when the dual trigger is pulled back to fire the rifle. The upper portion 28 of the dual trigger 12 is very similar to the upper portion of an original single trigger. It includes a pivot location 44, and, in this dual trigger, an insertable hammer contact element 46. The insertable hammer contact element 46 provides a hard contact surface for contacting the steel hammer (not shown) in place of the less hard aluminum, or other material, of the trigger. The insertable hammer contact element 46 is retained in place by a fastener such as the flat head screw 48. The flat head screw 48 screws into a threaded bore 50 formed in the upper portion 42 of the dual trigger 12. A second bore 52 is formed in the upper portion of the dual trigger to accommodate a spring 54.

The section of the dual trigger that contacts the shooter's fingers is a smooth, rounded surface 66 that provides a good and generally low friction surface to interface with a shooter's fingers or his gloved fingers. A structural rib 68, in one embodiment provided with holes or indentations, is formed in the dual trigger to add structural support to the dual trigger.

In each of the FIGS. 1-3 the relationship between the upper trigger portion 28 and the lower trigger portion 26 shows that the lower trigger portion 26 is offset toward the rear of the upper trigger portion. That is the lower trigger portion and the upper trigger portion are not vertically aligned. The upper trigger portion is closer to the barrel of the rifle than the lower trigger portion. This offset is ergonomically more comfortable to a user to a user of the dual trigger equipped AR-15.

It is preferred to cast, machine, or fabricated the dual trigger from aluminum with steel or other hard metal elements in wear zones or areas where the trigger contacts other components of the rifle such as, but not limited to, the insertable hammer contact element 46. The inventor also contemplates making the dual trigger from non-aluminum metals, such as, but not limited to steel, or from non-metallic materials such as high performance plastics or other polymer based materials. Metal inserts may be necessary at wear points when non-steel materials are used to form the trigger.

The dual trigger guard 14 includes a bore 30, which includes a counter bore to provide a step in the bore 30, at one end of the dual trigger guard 14. This bore 30 accommodates a spring and a spring-loaded pushpin. At the other end of the dual trigger guard there is a first pin receiving through bore 32. When the dual trigger guard is attached to lower receiver it is attached using the spring loaded trigger guard push button 16, which is backed up and spring-loaded by a push button spring 58. The push button spring 58 and the spring loaded trigger guard push button 16 are retained using a retainer pin 56 which will extend from the top face of the upper section of the 24 of the trigger guard, through the trigger guard to the opposite face of the upper section of the trigger guard to hold the front of the dual trigger guard in position in the lower receiver of the AR-15. This push button subassembly comprises the acts of putting the spring-loaded push button into the bore 30. A protruding ridge or collar on the push button will contact the stepped down ridge or protrusion in the bore 30 preventing the push button from passing all the way through the bore 30. The push button spring is then inserted into the bore and contacts the spring loaded trigger guard push button 16 at the wide base of the spring loaded trigger guard push button 16. The push button spring 58 is then held in a compressed state by the retainer pin 56 inserted through a through bore in the dual trigger guard.

Figure 4:
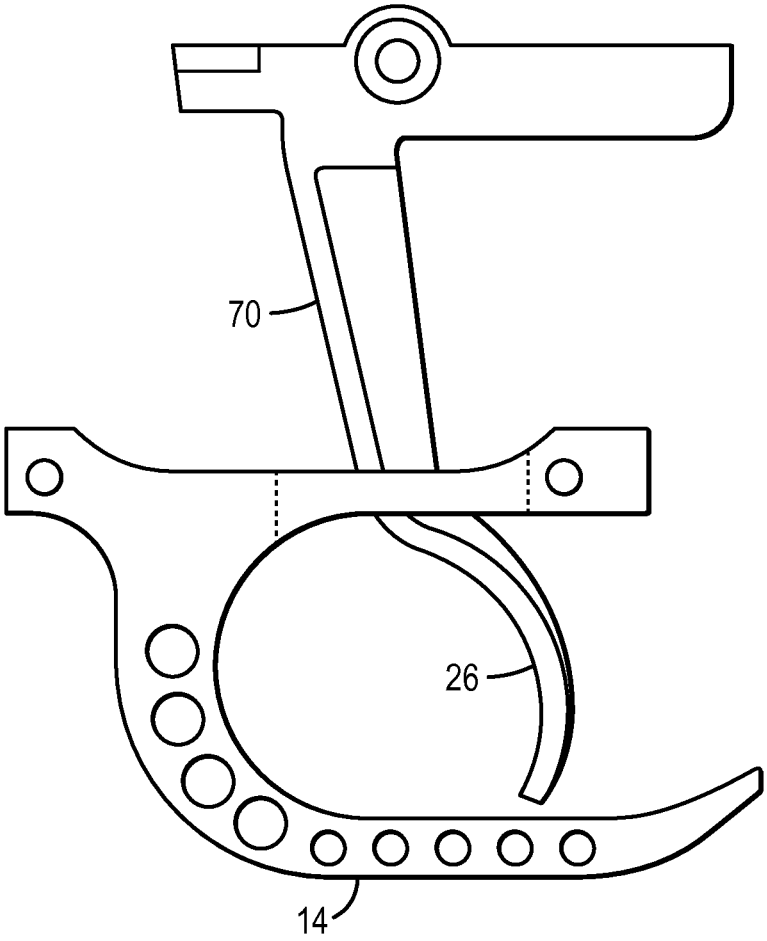
FIG. 4 is an embodiment of the invention having a single lower trigger bow.
Figure 5:
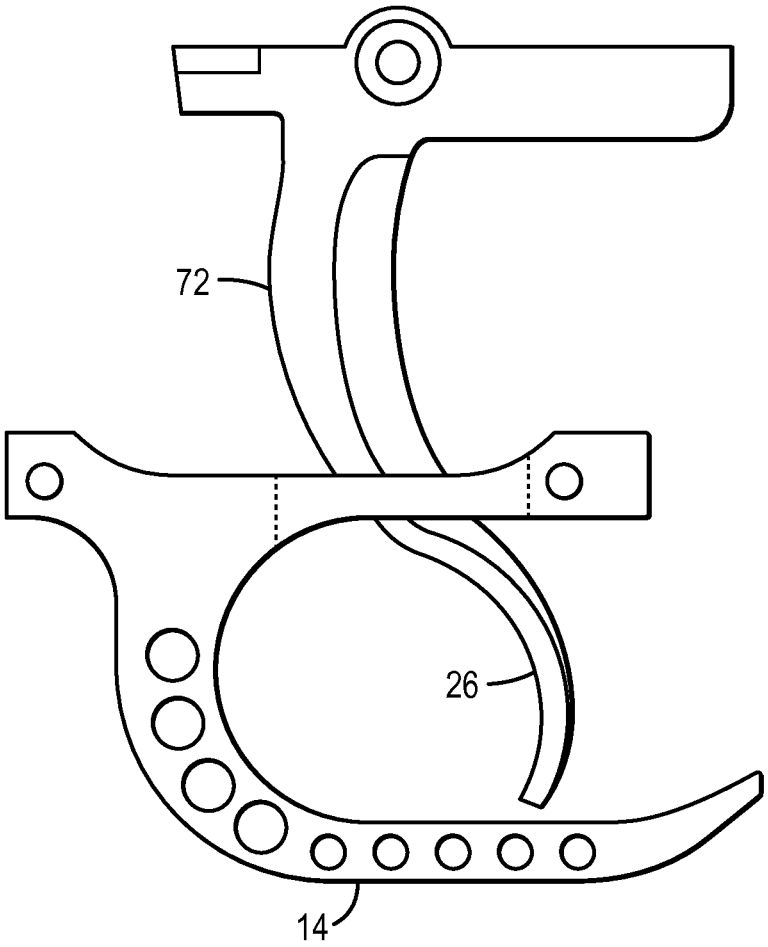
FIG. 5 is an embodiment of the invention where the trigger assembly is modified to have a reverse curve in place of an upper trigger bow.

FIGS. 4 and 5 present alternative embodiments of the invention. In FIG. 4 the upper trigger bow area is replaced with a generally straight section 70 of the trigger that connects to the transition zone that connects to the lower trigger bow.

FIG. 5 is a further embodiment where the upper trigger bow area is replaced with a reverse curve section 72 as shown in the figure. This reverse curve section will also connect with the lower trigger bow section through the transition zone.

In an alternative embodiment the trigger pivot pin 64 and the host pivot location 44 may be replaced with a roller bearing element to allow the trigger pivot to rotate more freely and with less resistance.

The layout and structure of the dual trigger 12 and the dual trigger guard 14 allows the new dual trigger 12 to be fitted directly into the location of the original single trigger on an AR-15, after the single trigger assembly has been removed from the lower receiver. No machining of the lower receiver assembly is required. No special gunsmithing skills are needed. The whole replacement of the original single trigger assembly with the replacement dual trigger assembly is easily done by the owner of an AR-15 semi-automatic rifle.

An advantage of the dual trigger assembly presented here has to do with pull weight of the trigger. The upper trigger portion or upper trigger bow 28 of the dual trigger has approximately the same pull weight as a stock AR-15 trigger. Therefore, when utilizing a standard weight trigger spring, the average-pull weight of the upper trigger is seven to seven and a half pounds. The pull weight of the lower trigger 26 is reduced by fifty-five to sixty percent, due to the additional leverage afforded by the lower trigger distance from the pivot location 44

In addition to the reduced trigger pull of the lower trigger, when a shooter uses her index and middle fingers simultaneously, as opposed to just her index finger the increased strength of her middle finger translates to her ability to pull the trigger faster.

The invention includes the method of retrofitting a dual trigger assembly to an AR-15 or an AR-15 look-alike or clone. It is anticipated by the inventor that this dual trigger assembly could be used with firearms other than the AR-15. Some detail modifications may be necessary to the embodiments shown here but these modifications would be addressed more to mounting, fitting and structural considerations to make a dual trigger for a particular firearm.

The method of fitting the embodiment of the dual trigger presented herein includes, at least, the acts of removing the original trigger guard and removing the original single trigger. Mounting pins may be reused to mount the replacement dual trigger assembly and dual trigger guard. After removal of the original parts the dual trigger is mounted in the same location as the original single trigger assembly. With that in place the dual trigger guard can be installed. The lower trigger 26 of the dual trigger will pass through the cavity 20 in the dual trigger guard and the dual trigger guard will be mounted in the location of the original guard using the same mounting location and mounting pins if desired.

A more detailed series of acts for removing the single trigger from an AR-15 and of installing the dual trigger assembly in place of the single trigger are recited below. In addition to the acts shown and described here, other acts may be necessary to carry out the trigger replacement. Likewise, not all of the recited acts may be necessary in all situations. The order of the acts may vary depending on circumstances and the skill set of the person performing the operation. The acts may include the following.

To take the AR-15 down. Clear the rifle by removing the magazine and ejecting any cartridge in the firing chamber. Make sure the rifle is clear and that there are no cartridges in the rifle. Push out the front and rear take-down pins. Pull the frame down and back to separate the upper receiver and barrel assembly from the frame. Place a thumb over the hammer and pull the trigger gently to lower the hammer. Place the lower receiver on its side on a bench, supported on each end so there is a space between the lower receiver and the bench. Remove the hammer using an ⅛-inch punch to push out the hammer pivot pin allowing removal of the hammer.

Push out the trigger pivot pin making sure that the disconnector doesn't fly out. Remove the trigger. Remove the original trigger guard by removing the rear pivot roll pin or setscrew. Support the opposite side of the lower receiver before removing the rear pivot roll pin. Engage front push button pivot roll pin and remove the trigger guard.

To install the dual trigger. Engage the front push button pivot roll pin and pop the trigger guard in place on the lower receiver. Use a nylon bushing to back up the side plate of the lower receiver. Insert the rear pivot roll pin by hammering or pressing it home making sure the nylon bushing is in place under the side plate of the lower receiver. Insert the disconnector into the top of the dual trigger. Lightly grease the disconnector. Take the trigger spring off the single trigger that is being replaced and install it on the double trigger from the front as it was on the single trigger. Install the 5⁄32-inch slave pin that came with the dual trigger kit. Insert the double trigger and disconnector assembly through the top of the lower receiver. Push the disconnector down against the spring tension and align the holes of the double trigger/disconnector assembly with the holes in the lower receiver. Insert the trigger pivot pin 64 and make sure it is properly seated.

Install the hammer over the trigger. The two forks of the springs straddle the trigger and rest on the trigger pivot pin. Push the hammer down to line up the hole with the hole in the lower receiver. Insert a ⅛-inch punch all the way through the lower receiver and hammer to temporarily hold the pieces together. Insert the hammer pivot pin from the opposite side while pulling out the punch making sure the hammer pivot pin is properly seated.

Cock the hammer and ensure that the disconnector catches the hammer. Test the safety for function. With the safety engaged pull the trigger. The hammer must not fall. Turn the safety to "fire." Pull the trigger while holding the hammer. The hammer normally falls. If the safety functions properly reassemble the rifle.

Visit a firing range. Load a single cartridge in the magazine. Engage the safety and chamber the round. Pull the trigger and ensure the rifle does not fire with the safety engaged. Turn the safety to "fire" and fire the round.

Load two rounds in the magazine. Chamber and fire the first round. The rifle must only fire a singe round. If the gun fires two rounds with one trigger pull the disconnector is not working The trigger assembly must be disassembled and repaired.

The rifle is now converted into a dual trigger rifle and is ready to be operated.

Operation using the dual trigger may be found to be easier to operate, faster to operate and more versatile then the original single trigger design. Since no modifications to the lower receiver assembly was necessary in the conversion it is simply a matter of removing the dual trigger assembly parts and reinstalling the single trigger assembly parts in the event it is necessary or desirable to return the rifle to its original single trigger configuration.

In summary, the invention is a dual trigger and trigger guard for a firearm that comprises an upper portion of the dual trigger, the upper portion having a pivot location and a forward portion of the upper portion extending forward from the pivot location, an insertable hammer contact element carried on the forward portion of the upper portion of the dual trigger, the upper portion further having a rearward portion extending rearwardly from the pivot location. The dual trigger has an upper trigger bow extending downwardly from the upper portion of the dual trigger. This upper trigger bow has a smooth rounded surface curved toward the rear of the upper trigger bow. The upper trigger bow is connected by a transition zone extending downwardly from the upper trigger bow, the transition zone curved in a direction opposite the curve of the smooth rounded surface of the upper trigger bow, to a lower trigger bow. This lower trigger bow extends downwardly from the transition zone, and also has a smooth rounded surface curved toward the rear of the lower trigger bow. In one embodiment of the invention the lower trigger bow is vertically offset rearwardly relative to the upper trigger bow. A functional and ascetically pleasing structural rib is carried on the rear side of the upper trigger bow and the lower trigger bow. The structural rib may also extend behind the transitional zone.

The second part of a dual trigger and guard assembly is the trigger guard. It has an upper section with a forward section and a transition section and includes a cavity of sufficient width and length to accommodate the transition zone of the dual trigger and allow the dual trigger to move laterally in the cavity during operation of the dual trigger. This trigger guard may have a valley section in the upper section of the trigger guard. It may also have a trigger guard pin receiving through bore near one end of the upper section of the trigger guard and a push button receiving bore at the opposite end of the upper section of the trigger guard.

In another embodiment of the invention, where there is only a lower trigger, at least two alternative embodiments are contemplated. In summary these include a trigger for a firing arm comprising an upper portion having a pivot location, an upper trigger portion having a straight leading edge extending from the upper portion of the trigger to the lower portion of the trigger or lower bow of the trigger. For instance, the upper trigger portion of the preferred embodiment could be replaced with a straight element from the upper portion to the lower trigger portion. In an alternative embodiment the upper trigger portion with the straight leading edge extends to a transition zone before connecting to the lower portion of the trigger.

The second embodiment in an alternative configuration the upper trigger portion has a reverse curve extending from the upper portion of the trigger to the lower trigger bow. Alternatively the reverse curve upper portion may extend to a transition section with the lower trigger bow extending downwardly from the transition section.

While the invention is described herein in terms of preferred embodiments and generally associated methods, the inventor contemplates that alterations and permutations of the preferred embodiments and methods will become apparent to those skilled in the art upon a reading of the specification and a study of the drawings. For instance, the dual trigger could be made of any durable material. It could be sold as a set of elements, including at least a trigger and a trigger guard or it could be sold as separate pieces.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

What is claimed is:

1. A trigger for a semi-automatic firearm, the firearm for launching a bullet, the bullet initially carried in a cartridge, the cartridge containing a primer and a powder propellant, the primer and subsequently the powder propellant capable of being detonated by increased compression in the primer of the cartridge and subsequently increased compression in the powder propellant in the cartridge resulting from a hammer contacting a firing pin of the firearm when the hammer is released by actuation of the trigger, the trigger comprising:

a trigger guard having a cavity in an upper section of the trigger guard for accommodating the trigger;

an upper portion of the trigger, the upper portion having a pivot location and a forward portion of the upper portion extending forward from the pivot location, the upper portion further having a rearward portion extending rearwardly from the pivot location;

an upper trigger bow for releasing the hammer, the upper trigger bow extending downwardly from the upper portion of the trigger, the upper trigger bow having a smooth rounded surface curved toward the rear of the upper trigger bow;

a transition zone extending downwardly from the upper trigger bow, the transition zone curved in a direction opposite the curve of the smooth rounded surface of the upper trigger bow, the transition zone curve providing clearance between the trigger and the upper section of the trigger guard when the trigger is at its fully displaced location;

a lower trigger bow for releasing the hammer, the lower trigger bow extending downwardly from the transition zone, the lower trigger bow having a smooth rounded surface curved toward the rear of the lower trigger bow, the lower trigger bow being vertically offset rearwardly relative to the upper trigger bow.

2. A trigger and trigger guard for use in a firearm, the firearm for launching a bullet, the bullet initially carried in a cartridge, the cartridge containing a primer and a powder propellant, the primer and subsequently the powder propellant capable of being detonated by increased compression in the primer of the cartridge and subsequently increased compression in the powder propellant in the cartridge resulting from a hammer contacting a firing pin of the firearm when the hammer is released by actuation of the trigger, the trigger comprising:

a trigger guard having an upper section with a forward section and a transition section;

an upper portion of the trigger, the upper portion having a pivot location and a forward portion of the upper portion extending forward from the pivot location, the upper portion further having a rearward portion extending rearwardly from the pivot location;

an upper trigger bow integral with and extending downwardly from the upper portion of the trigger, whereby displacement of the upper trigger bow will displace the upper portion of the dual trigger and release the hammer, the upper trigger bow having a smooth rounded surface curved toward the rear of the upper trigger bow;

a transition zone extending downwardly from the upper trigger bow, the transition zone curved in a direction opposite the curve of the smooth rounded surface of the upper trigger bow, the transition zone curve providing clearance between the trigger and the upper section of the trigger guard when the trigger is at its fully displaced location;

a lower trigger bow extending downwardly from the transition zone, whereby displacement of the lower trigger bow will displace the upper portion of the dual trigger and release the hammer, the lower trigger bow having a smooth rounded surface curved toward the rear of the lower trigger bow, the lower trigger bow being vertically offset rearwardly relative to the upper trigger bow;

the trigger guard further comprising an upper section with a forward section and a transition section and including a cavity of sufficient width and length to accommodate the transition zone of the trigger without contact between the transition zone of the trigger and the trigger guard and allowing the trigger to move laterally in the cavity during operation of the trigger;

the trigger guard having a valley section in the upper section of the trigger guard; and a trigger guard pin receiving through bore near one end of the upper section of the trigger guard and a push button receiving bore at the opposite end of the upper section of the trigger guard.

* * * * *